US006413470B1

(12) United States Patent
Kramer

(10) Patent No.: US 6,413,470 B1
(45) Date of Patent: Jul. 2, 2002

(54) DEVICE FOR GUIDING BANDS IN A SUSPENDED MANNER

(76) Inventor: Carl Kramer, Am Chorusberg 8, D-52076 Aachen (DE)

( * ) Notice: Subject to any disclaimer, the term of this patent is extended or adjusted under 35 U.S.C. 154(b) by 0 days.

(21) Appl. No.: 09/601,202

(22) PCT Filed: Feb. 3, 1999

(86) PCT No.: PCT/EP99/00698

§ 371 (c)(1),
(2), (4) Date: Sep. 27, 2000

(87) PCT Pub. No.: WO00/40230

PCT Pub. Date: Aug. 12, 1999

(30) Foreign Application Priority Data

Feb. 3, 1998 (DE) ..... 198 04 184

(51) Int. Cl.[7] ..... C21D 9/54
(52) U.S. Cl. ..... 266/111; 266/103; 266/274
(58) Field of Search ..... 266/111, 105, 266/102, 274

(56) References Cited

U.S. PATENT DOCUMENTS 3,048,383 A 8/1962 Champlin
5,320,329 A * 6/1994 Hoetzl et al. ..... 266/111
5,616,295 A * 4/1997 Tawara et al. ..... 266/103

FOREIGN PATENT DOCUMENTS

DE 33 18 861 11/1984
DE 40 10 280 10/1991
FR 1 421 631 3/1966

* cited by examiner

*Primary Examiner*—Scott Kastler
(74) *Attorney, Agent, or Firm*—Renner, Otto, Boisselle & Sklar, LLP

(57) ABSTRACT

The invention relates to a device for guiding bands in a suspended manner and for stabilizing bands, preferably wide metal bands, for the purpose of heat treating the same. In the device, the band is blown on both sides with the aid of suspended nozzle sections, and two respective radial ventilators with 360° spiral casings are arranged on the side walls of the device in the vicinity of both sides of the band. The intake openings of the radial ventilators point toward the middle of the device. The axes of the radial ventilators are vertical in relation to the side walls, and the radial ventilators are arranged in such a way that they deliver air into air delivery channels (6) of the length of at least one hydraulic diameter in a manner parallel to the longitudinal direction of the device, that is, in a direction of movement of the band. The air delivery channels (6) are adjacent to the upper casing (8) or the lower casing of the device via a side wall. Elbows are respectively connected to the air delivery channels (6). The volume stream delivered from said elbows by the radial ventilator enters a collecting receptacle which extends as at least one piece over the entire length of the device and which is provided with the nozzle section on the side facing the band, said nozzle field being approximately equal in width to that of the collecting receptacle. The gas stream blown on the band predominantly flows away and up to the longitudinal sides of the device and enters from the sides of the device into the suction area between the radial ventilators above and below the band (1).

17 Claims, 6 Drawing Sheets

DEVICE FOR GUIDING BANDS IN A SUSPENDED MANNER

The invention relates to a device in which bands guided in a suspended manner, preferably wide metal bands, are held in suspension by being blown with treatment gas from above and below and are thereby simultaneously heat treated. Heat treatment may involve heating and maintaining the annealing temperature as well as subsequent cooling for metallurgical purposes or also for the purpose of surface treatment such as, e.g., drying a band coating.

Such devices are configured as a rule of a plurality of sections or zones joined in sequence, and including, as is the case in, for example, German published patent specifications DE 2446983.8 or DE 4010280 A1, a flow guide for each section, having at least one ventilator and nozzle fins arranged above and below the band, oriented transversely to the run of the band, with which the band is blown with the gas circulated by the ventilator for the purpose of convective heat exchange, and, at the same time, stabilized more or less effectively by the active flowing forces. In particular, devices for operation at elevated gas temperatures are usually equipped with radial ventilators for reasons relating to adequate structural strength.

Although the device in accordance with specification DE-OS 2446983.8 has a particularly compact design as only one ventilator is arranged at the side per section, simply regulation of the supporting force by altering the ventilator speed, e.g. to adapt to the weight of the band to be guided in a suspended manner, is not possible since the single ventilator supplies both upper and lower nozzle sections simultaneously and this would influence upper and lower nozzle systems alike. In addition, the device according to specification DE-OS 2446983.8 has the disadvantage that the return flow of the treatment gas, blown onto the band, occurs only on one side to the ventilator. This causes a cross-flow heat exchange between the return flow from the band and the supply flow in nozzle fins, with the result that, e.g., in a heating zone, in which the gas blowing off the band is colder than that blown onto the band, the temperature of the blown gas decreases along the bank of nozzles from the side facing away from the ventilator to the ventilator side.

Although the device according to German published patent specification DE 40120280 A1 avoids this disadvantage by alternating the supply flow to the bank of nozzles within a section, it is, however, highly complicated and expensive to manufacture, due to the nozzle fins, which also need to be provided with a complicated arrangement of flow duct means in order to achieve a flow impinging the band precisely perpendicular over the entire working width. Furthermore, using nozzle fins in a device in accordance with DE 40120280 A1 also has the disadvantage that, in the case of heavy bands, the total return flow from the band can only occur between the nozzle fins because the side regions of the device are blocked by the supply ducts which feed the nozzle fins. As a result, the overpressure needed for supporting the band from below is built up again, stripwise, i.e. between the nozzle fins, by the convective acceleration of the air between the nozzle fins. Thus, boosting the nozzle exit velocity results in an increase in the supporting force only in part, since, to extreme disadvantage, the convective acceleration between the nozzle fins likewise increases with the increase in the jetting velocity and the resulting increase in the overpressure on the product web in the region of the bank of nozzles. This results in a drop in the static pressure in this region, as a result of which most of the boost in the supporting force, gained by increasing the velocity, is again forfeited. The consequences are relatively high ventilator power requirements and the supporting force being restricted to unit weights, which, in the case of an annealing plant for metal bands, are insufficient to guide heavy non-ferrous metal bands, steel bands or light metal alloy bands of greater thickness.

An object of the invention is thus to provide a device of the aforementioned kind, which obviates the disadvantages described. More particularly, the intention is to provide a device which is relatively uncomplicated and compact and which avoids the disadvantages of returning the gas stream, blown by the bank of nozzles onto the band which is to be guided in a suspended manner, only through intermediate spaces between the nozzle fins.

This is achieved by the features as set forth in claim 1, The sub-claims describe advantageous aspects. Preferred embodiments feature, for example the following features:

The return flow from the band in the suction zones of the radial ventilators is made primarily to both sides of the device.

Arranged above and below the band are nozzle sections, each respectively extending over the entire working width and the entire length of the device, each respective nozzle section receiving blown gas from a collecting receptacle located above or below the nozzle section.

Incorporated in each side wall, above and below the plane of the band, is a radial ventilator, preferably a spool rotor ventilator, accommodated in a 360° spiral casing. Connecting to the 360° spiral casing is an air delivery channel, which is at least as long as a hydraulic diameter of the duct running parallel to the respective side wall. Each of the intake openings of the ventilators point toward the vertical longitudinal center plane of the device.

Connecting each air delivery channel is a first elbow running parallel to the plane of the band. This first elbow ports into a second elbow, which is parallel to the vertical section through the device, this second elbow translating into a vertical duct, from which the collecting receptacle or supply chamber is fed for each nozzle section.

Due to the air delivery channels of two opposing radial ventilators being arranged opposing each other in one half of the device, above or below the plane of the band, the supply chamber of the nozzle section is fed via two inlet openings in each face wall of the device.

The free space remaining between the ventilator spiral casing and the face wall of the device may be used as an access opening in the corresponding upper or lower part of the device or for installing heating means.

By arranging the ventilators with a spiral casing with the intake opening adjoining the top or bottom of the device, a free space remains between the collecting receptacle or supply chamber for the nozzle section and air delivery channel of the corresponding side wall, in which openings for installing burners, radiant heating tubes and similar also exist.

Coolers for cooling the gas stream, circulated by the ventilators, may be incorporated parallel to the collecting receptacles for the nozzle section on both sides of the nozzle boxes relative to the side wall, i.e. two in the upper and two in the lower half of the device.

The coolers may be accommodated in collecting receptacles, integrated in the outer wall, so that the same device may be used to both heat and cool the band, the coolers being taken out of circuit when the device is being operated as a heating zone, i.e. for heating the band. The face wall of the cooler assembly, facing the interior, is then provided with a suitable thermal insulation.

The nozzle section may consist of individual part nozzles interconnected by semi-open ducts to facilitate the predominantly lateral flow-off. However, a nozzle box with a nozzle plane may also be used, incorporating flow-off orifices penetrating the box in the direction perpendicular to the plane of the band. The flow-off orifices may be dimensioned such that, depending on the unit weight to be supported, a more or less large gas volume exits through the flow-off orifices and a more or less large proportion of the gas stream blown onto the band flows off laterally, the ratio of lateral flow-off to the flow-off through the openings penetrating the nozzle box being involved in dictating the level at which the band is to be suspended.

In the following, the device in accordance with the invention is described by way of a heat treatment system for guiding wide metal bands in a suspended manner as an example. Such a wide band is 1000 mm to 2500 mm wide. FIGS. 1 to 6 aid explanation of the invention.

Figure 1:
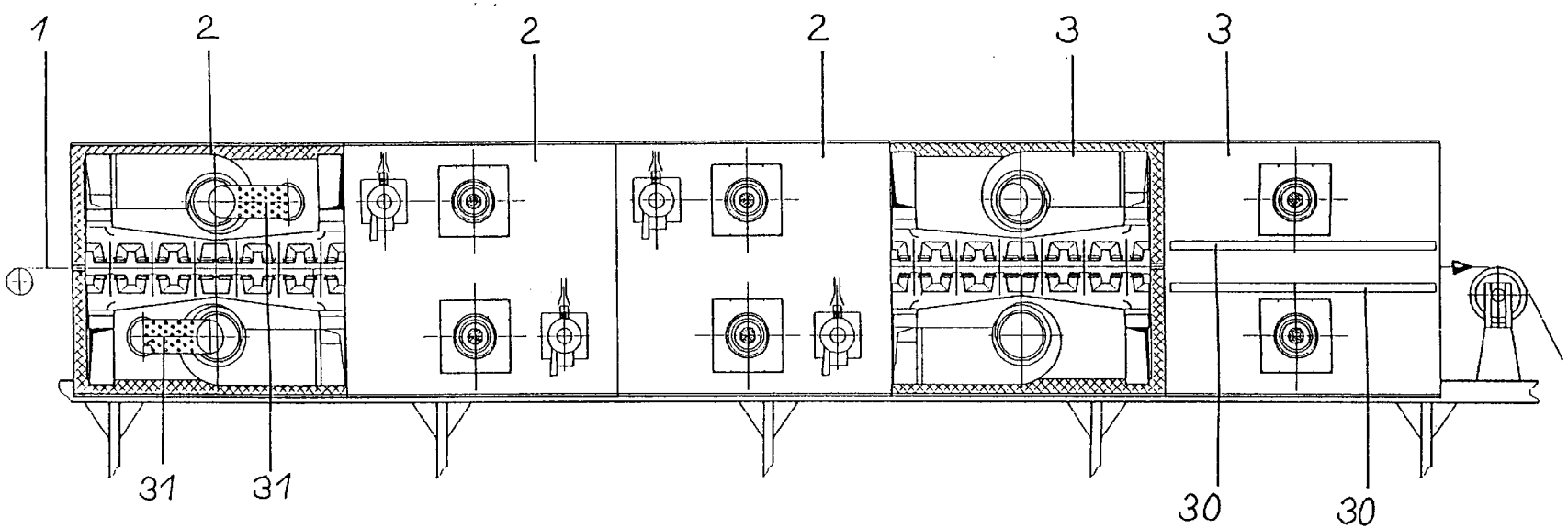
FIG. 1 is a vertical longitudinal section through a system comprising several heating and cooling zones.

The system illustrated in FIG. 1 consists of four heating zones 2 and two cooling zones 3. In the cooling zone 3, the installation location for the coolers is identified by the reference numeral 30, the coolers being used to re-cool the return gas stream circulated in the cooling zone which cools the band. Indicated in the heating zone 2 is the direct gas heating, chosen by way of example, by flame tubes 31. A metal band 1 runs horizontally through the system from right to left. It is also possible to guide the band through the system inclined, the limit of which is 90° relative to the horizontal representing a vertical system, in which the band is suspended vertically and need not be supported, but, nevertheless, is stabilized in the central position fluidically by being blown with nozzles sections from both sides.

Arranged at the inlet and outlet of the system making consisting of heating zones 2 and cooling zones 3 are the means for driving the band, usually comprising rollers substantially, the means for centering the band and for regulating band tension.

Each zone 2, 3 comprises a device for guiding the metal band 1 in a suspended manner.

Figure 2:
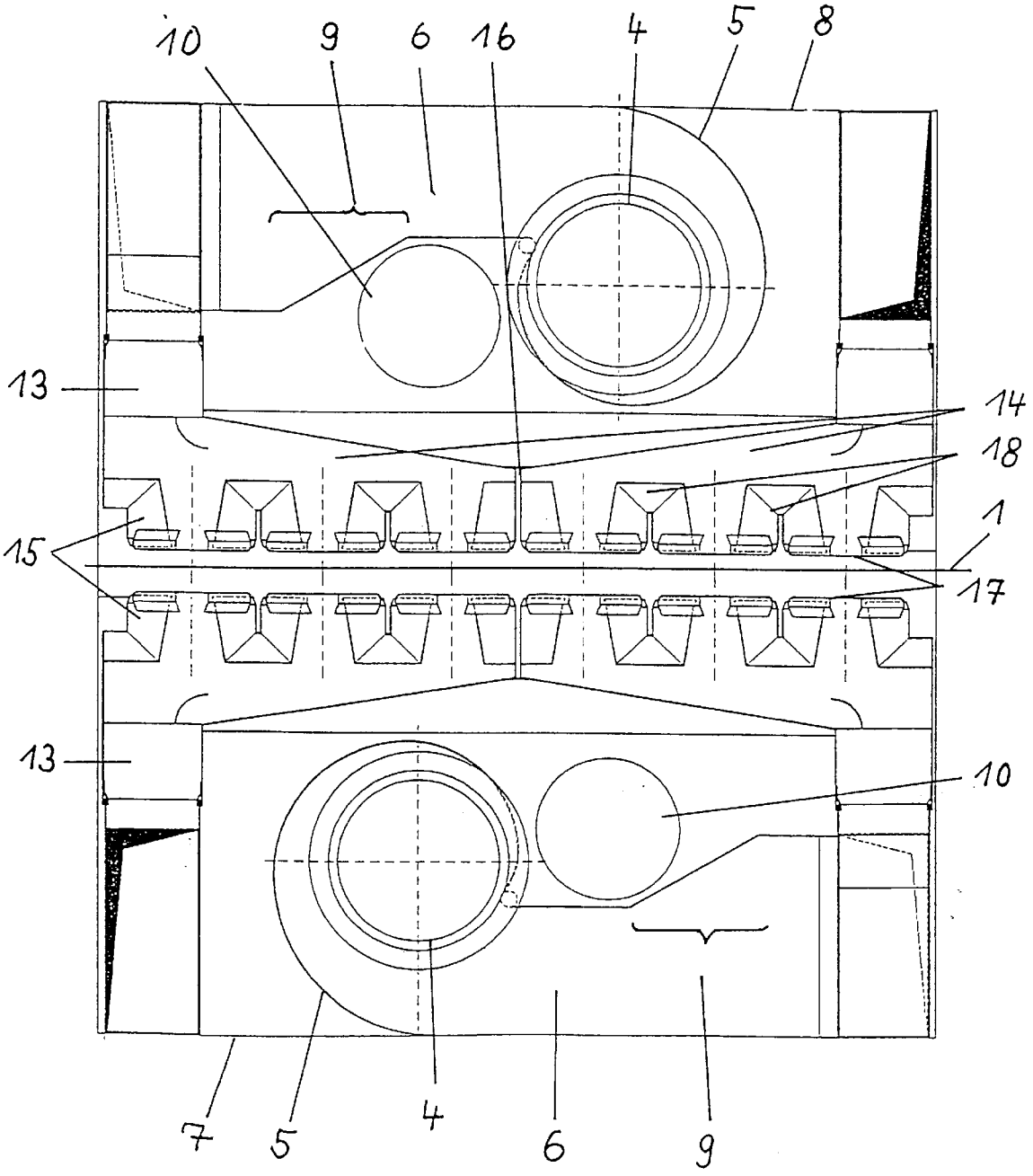
FIG. 2 is a vertical longitudinal section through a zone with the device in accordance with the invention.
Figure 3:
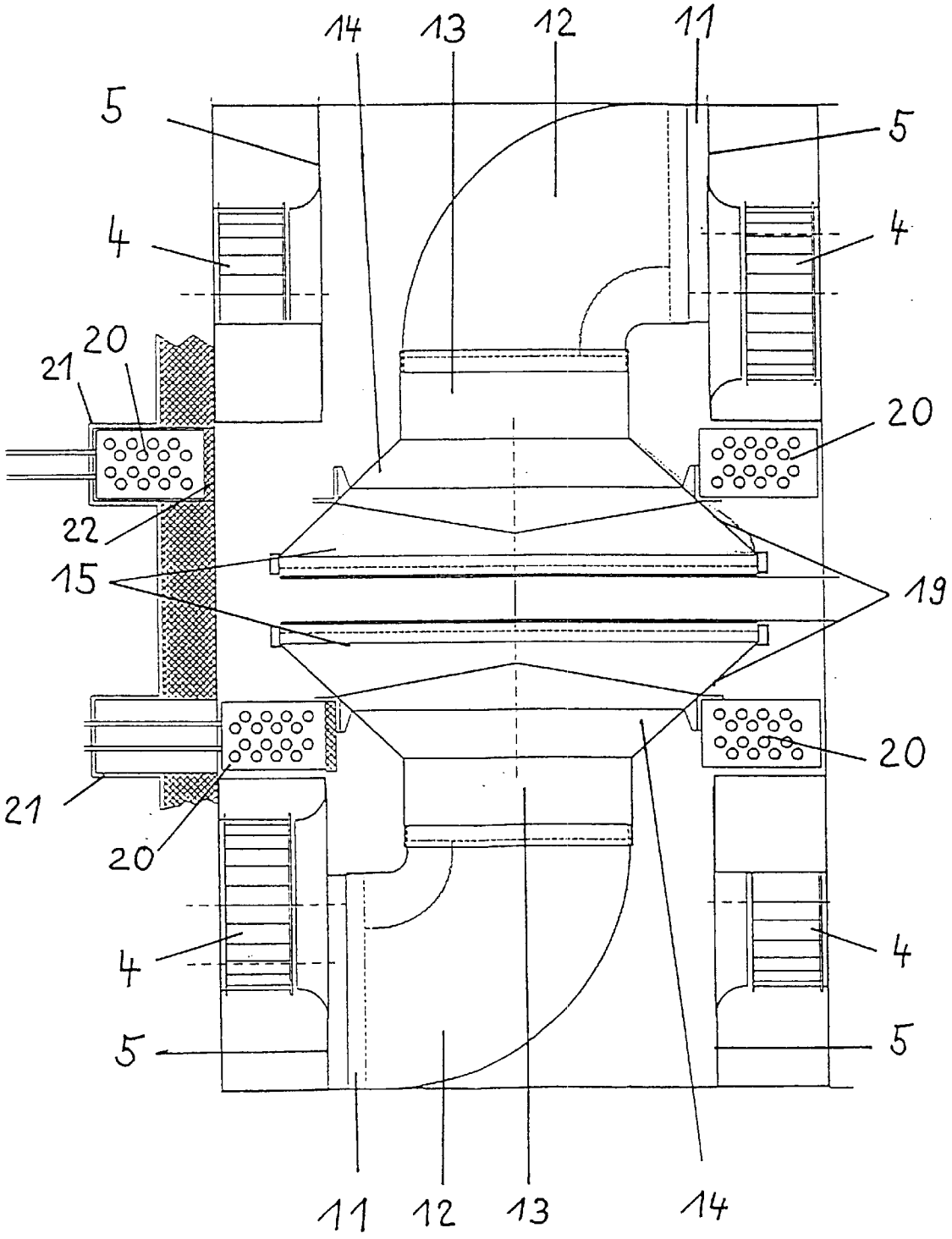
FIG. 3 is a vertical cross-section through a zone with the device in accordance with the invention.
Figure 4:
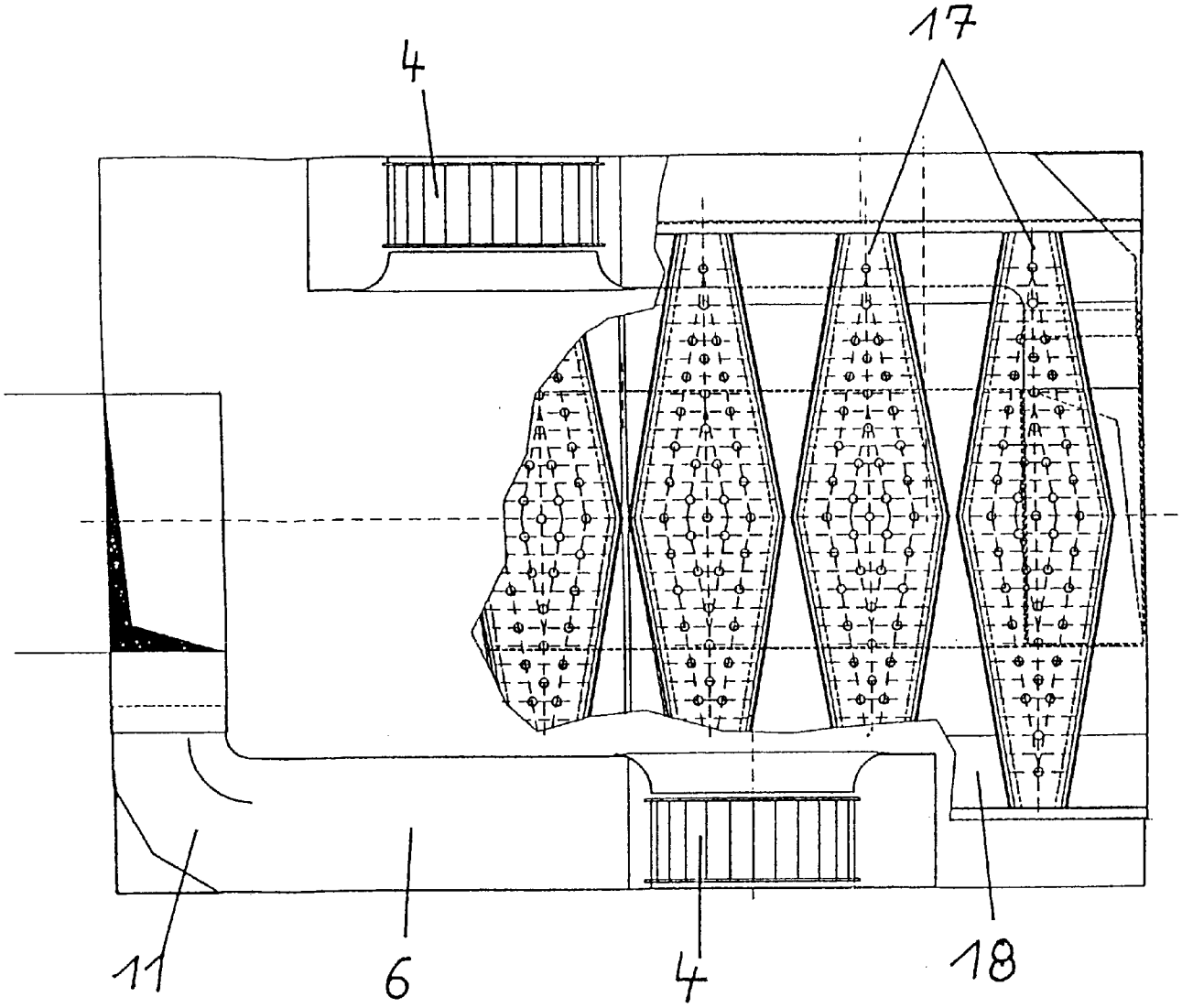
FIG. 4 is a horizontal section through a zone.

As illustrated in FIGS. 2 and 3, each zone 2 and 3 of the system includes four radial ventilators 4 incorporated in the side walls. Due to their particularly compact design and the high delivery and pressure capacity as compared to that of other radial ventilators, spool rotor radial ventilators are particularly suitable for this purpose.

The spool rotor radial ventilators 4 are incorporated in 360° spiral casings 5, which have the advantage that, in such casings, the spool rotors 4 are able to develop their full capacity as regards pressure and volume stream rate. Connecting each 360° spiral casing 5 is a straight air delivery channel 6, which is at least as long as a hydraulic diameter of the air delivery cross-section. Such an air delivery channel 6 is required to be in connection with the 360° spiral casing 5 so that the spool rotor ventilator 4 is able to develop its full delivery capacity. The air delivery channel 6 runs parallel to the run of the band and is directed, opposing in each case, for the two radial ventilators 4, incorporated facing each other in the side walls of a device, as shown in the horizontal section through the device represented in FIG. 3. Each straight air delivery channel 6 of each ventilator 4 adjoins with one side the top 7 or bottom 8 of the device. In FIG. 3, the upper wall of the upper duct 6 adjoins the top 8 and the lower wall of the lower duct 6 adjoins the bottom 7.

At each opposing side, the air delivery channel 6, as shown in the horizontal longitudinal section in FIG. 2, is first drawn in, commencing at the tongue of the 360° spiral casing 5 and expands into the entire cross-section of the air delivery channel only after a certain running length in a portion 9. The free portion of the side wall, gained by this shape of the duct, in which the ventilator 4 is incorporated can be used for openings for installing the heating means, such as e.g. gas burners or gas-heated radiant heating tubes. The portion in which such openings can be incorporated is identified in FIG. 2 by the reference numeral 10.

Adjoining the air delivery channel 6 is a 90° elbow 11, whose axis is vertically arranged to the plane of the band, this elbow deflecting the volume stream delivered by the radial ventilator 4 in the direction of the middle of the device. This elbow 11 translates into a second 90° elbow 12, the axis of which is oriented parallel to the run of the band and which deviates the volume stream vertical to the band, i.e. in the lower half of the device, upwards and in the upper half of the device downwards.

Adjoining this second elbow 12 is a short, vertically arranged duct 13, from which the volume stream delivered by the ventilator 4 enters a collecting receptacle 14 which is mounted on a nozzle section 15 on its side facing the band 1. This collecting receptacle 14 may either extend in one piece over the entire length of the device or, as shown in FIGS. 2 and 3, may be split in the middle of the device, resulting in a gap 16 between the two parts. When the nozzle box is configured split in the middle of the device, each partial box is supplied by a ventilator. This has the advantage that, by changing the speed of the ventilators, the nozzle pressure can be varied in both boxes. In addition, the gap 16 between the two parts of a collecting receptacle 14 can be used to intercept any thermal expansion.

From the nozzle receptacle 14, the treatment gas streams into the nozzle section 15, then to the band I and from the band 1 back to the ventilator 4, the majority of the volume stream impinging the band 1 flowing off to the side, i.e. through the gap between the nozzle section 15 and the side wall of the device upwards or downwards into the suction region of the ventilator 4.

Depending on how the nozzle section 15 is configured, open return flow ducts 18 may be arranged between the nozzle planes 17, which in the example shown in FIGS. 2 and 3 have the shape of a rhombus, to the band. These return flow ducts 18 expand from the middle of the band to its edge when the nozzle sections 17 have the shape of a rhombus. In addition to this expansion due to the rhombus-shaped nozzle sections 17, a further expansion may occur in the direction perpendicular to the band 1. The air flowing off from the band 1 then gains access along the longitudinal edges of the collecting receptacle 19, facing away from the band, back into the space between the two ventilators 4, from which the volume stream is re-suctioned by the ventilators 4.

Advantageously with the device in accordance with the invention, coolers 20 (FIG. 3) may be arranged as a cooling zone along the side edges of the collecting receptacle 19, which may extend practically over the entire length of the device. Due to this large through-flow surface area, the pressure loss at the coolers 26 is comparatively low. Another advantage of this arrangement is also that the coolers 26 cannot only be very easily removed, but also that side-shifting them in housings 21 integrated in the side walls is possible. In this way, a zone of the device configured as a cooling zone may be also be used as a heating zone. To change from a cooling mode to a heating mode, the coolers 20 are simply moved into the housings 21. It is of advantage in this respect to provide the cooler, at the face pointing inwards in the extended condition, with a thermal insulation 22. Moving the coolers is simple since the connections for the cooling water can be configured flexible.

This embodiment of the device is particularly of advantage when intended for heat treating bands 1 of light metal alloys, some of which necessitate namely a relatively long holding time. For heat treating bands 1 of such alloys it is thus of advantage in a system consisting of several heating zones 2 and several cooling zones 3 to change over the cooling zones 3, adjoining the heating zones 2, partly into heating zones, i.e. for bands 1 which, due to the long holding time needed for maximum annealing temperature, could otherwise only be moved very slowly through the system. Accordingly, this possibility offered by the device in accordance with the invention represents a major advantage for production and more particularly for cost effectiveness.

Figure 5:
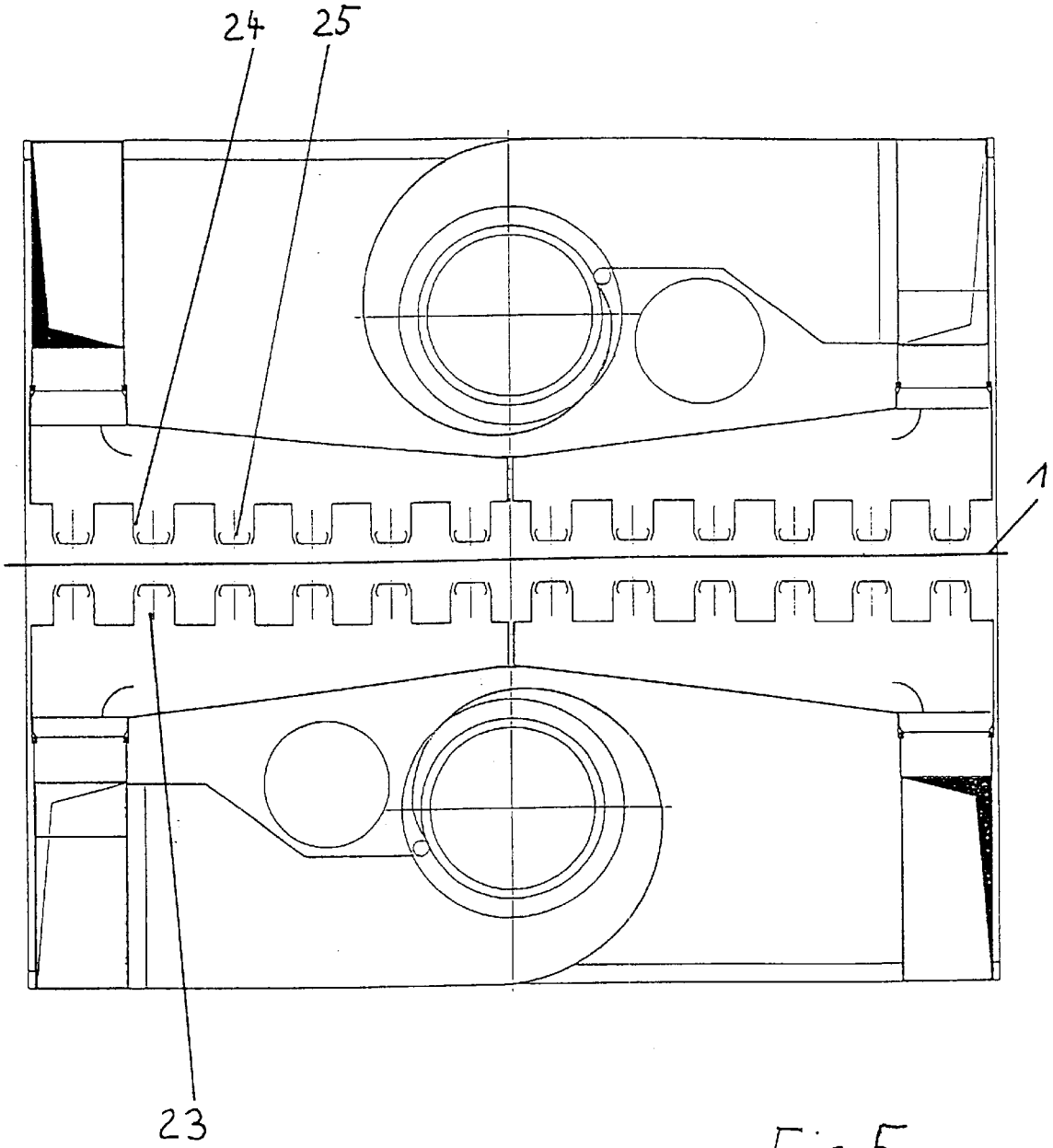
FIG. 5 is an illustration of another embodiment of the nozzle section with the flow supply collecting receptacle located therebelow.
Figure 6:
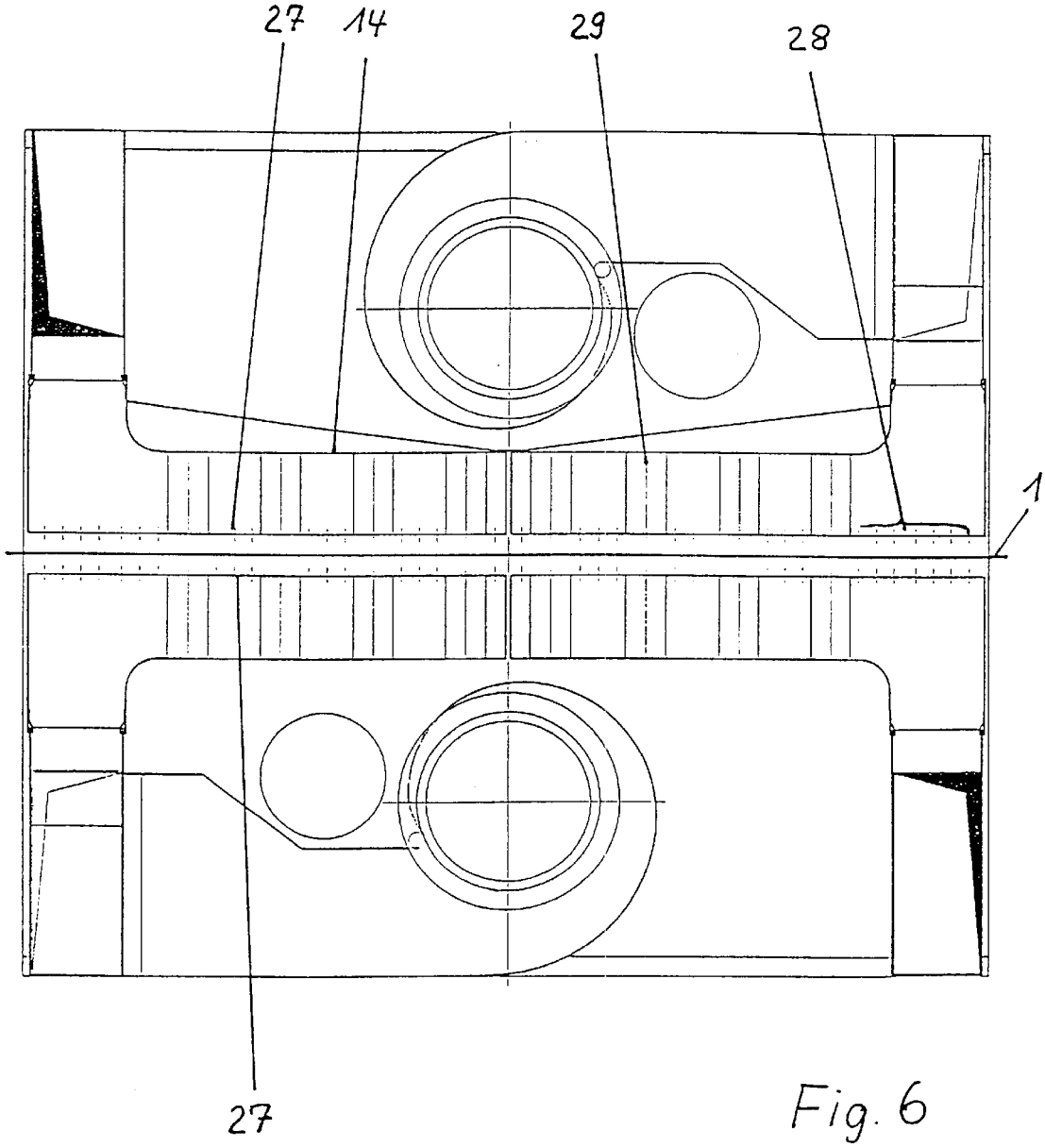
FIG. 6 is an illustration of the nozzle section configured as a nozzle plate, in which return flow openings for the partial flow-off perpendicular to the surface of the band are integrated in the form of ducts passing vertically through the nozzle box.

Instead of the rhombus-shaped nozzle sections 17 previously described, conventional banks of suspended nozzles 23 comprising slot 24 and orifice jets 25 may be located on the nozzle box, as shown in FIG. 5. However, it is also possible to configure the nozzle box as indicated in FIG. 6. The side of the nozzle section facing the band is a flat plane 27, in which the nozzle orifices 28 are incorporated. Some of these nozzle orifices are grouped around return flow orifices formed by ducts 29 which pass through the nozzle box 14 in a direction vertical to the plane of the band. Part of the gas stream blown onto the band flows through these orifices directly back into the space between the ventilators 4. The major advantage afforded by this embodiment is its very simple production and the smooth plane, which, even in the case of fragile bands 1 or webs and when drawing in a new web or a new band 1, has no tendency whatsoever to possibly cause the band 1 to become snagged.

What is claimed is:

1. A device for guiding bands (1) in a suspended manner and for stabilizing bands for the purpose of heat treating, in which a) said band (1) is blown on both sides with the aid of nozzle sections (15, 17), and b) two respective radial ventilators (4) with 360° spiral casings (5) are arranged at side walls of the device, said radial ventilators (4) having intake openings pointing toward the middle of the device, characterized in that c) said radial ventilators (4) are arranged such that, in the longitudinal direction of the device, they deliver air into air delivery channels (6) having a length of at least one hydraulic diameter, said air delivery channels (6) being adjacent to the upper casing (8) or lower casing (7) of the device via a side wall, d) elbows (11, 12) are respectively connected to said air delivery channels (6) from which the volume flow delivered by said radial ventilator (4) enters a collecting receptacle (14) composed of one or more sections collectively extending along the length of the device, e) said collecting receptacle (14) is provided with said nozzle sections (15) on the side of said collecting receptacle facing said band, and f) the gas stream blown onto said band (1) predominantly flows to longitudinal sides of the device and enters from the sides of the device into a suction area (23) between said radial ventilators (4) above and below said band (1).

2. The device as set forth in claim 1, characterized in that adjoining each air delivery channel (6) is a 90° elbow (11) having an axis vertically arranged to the plane of said band, said elbow (11) translating into a second elbow (12) having an axis parallel to the run of said band and directing the flow delivered by said radial ventilator (4) to said band (1).

3. The device as set forth in claim 2, characterized in that a short duct (13), having an axis vertically arranged to the axis of said band, adjoins each second elbow (12), said duct (13) supplying said collecting receptacle (14).

4. The device as set forth in claim 1, characterized in that said radial ventilators (4) with said 360° spiral casings (5) are arranged in the side walls of the device.

5. The device as set forth in claim 1, characterized in that said nozzle sections (15) extend over the entire working width and the entire length of the device.

6. The device as set forth in claim 1, characterized in that a space remaining free between said spiral casing (5) of said radial ventilator (4) and a face wall of the device is provided with an access opening.

7. The device as set forth in claim 1, characterized in that heating means are arranged in a space remaining free between said spiral casing (5) of said radial ventilator (4) and a face wall of the device.

8. The device as set forth in claim 1, characterized in that coolers (20) are arranged parallel to said collecting receptacles (14) for said nozzle section (15) on both sides of said collecting receptacle (14).

9. The device as set forth in claim 8, characterized in that said coolers (20) can be shifted in housings (21) integrated in an outer wall of the device.

10. The device as set forth in claim 8, characterized in that a face wall of said coolers (20), facing the interior, is provided with a thermal insulation (22).

11. The device as set forth in claim 1, characterized in that said nozzle section (15) consists of individual part nozzles interconnected by semi-open ducts.

12. The device as set forth in claim 1, characterized in that said nozzle section is formed by a nozzle box with a nozzle plane (17).

13. The device as set forth in claim 12, characterized in that said nozzle plane (17) comprises open return flow ducts (18) open in the direction of said band (1).

14. The device as set forth in claim 13, characterized in that said return flow ducts (18) expand from the middle of said band to the edge of said band.

15. The device as set forth in claim 1, characterized in that a nozzle box is provided with a nozzle plane (27) in which nozzle orifices (28) are incorporated, which are partly grouped around return flow ducts (29) which pass through said nozzle box perpendicular to the plane of said band.

16. The device as set forth in claim 15, characterized in that the cross-sectional dimensioning of said return flow ducts (29) takes into account the unit weight to be supported.

17. A device for guiding bands (1) in a suspended manner and for stabilizing bands for the purpose of heat treating, in which a) said band (1) is blown on both sides with the aid of nozzle sections (15, 17), and b) two respective radial ventilators (4) with 360° spiral casings (5) are arranged at side walls of the device, said radial ventilators (4) having intake openings pointing toward the middle of the device, c) the axes of said radial ventilators (4) are perpendicular to said side walls and said radial ventilators (4) are arranged such that, in the longitudinal direction of the device, they deliver air into air delivery channels (6) having a length of at least one hydraulic diameter, characterized in that d) said air delivery channels (6) adjoin a side wall at said upper casing (8) or lower casing (9) of the device, e) elbows (11, 12) are respectively connected to said air delivery channels (6) from which the volume stream delivered by said radial ventilator (4) enters a collecting receptacle (14), f) said collecting receptacle (14) extends as at least one piece over the entire length of the device and is provided with said nozzle sections (15) on a side facing said band, said nozzle sections being approximately equal in width to that of said collecting receptacle, and g) the gas stream blown onto said band (1) predominantly flows to longitudinal sides of the device and enters from the sides of the device into a suction area (23) between said radial ventilators (4) above and below said band (1).

* * * * *